United States Patent [19]

Yamashita

[11] 4,158,974

[45] Jun. 26, 1979

[54] ADJUSTABLE OIL FILTER WRENCH

[75] Inventor: Teruo Yamashita, Kasai, Japan

[73] Assignee: Orion Industries, Inc., Compton, Calif.

[21] Appl. No.: 875,153

[22] Filed: Feb. 6, 1978

[51] Int. Cl.[2] ..... B25B 13/52

[52] U.S. Cl. ..... 81/64; 81/3.43

[58] Field of Search ..... 81/64, 3.43

[56] References Cited

U.S. PATENT DOCUMENTS

| | | | |
|---|---|---|---|
| 1,400,456 | 12/1921 | Petrak | 81/64 |
| 1,466,196 | 8/1923 | Seiders | 81/64 |
| 1,598,561 | 8/1926 | Coomer | 81/64 |
| 1,726,862 | 9/1929 | Schustarich | 81/64 |

*Primary Examiner*—James L. Jones, Jr.
*Attorney, Agent, or Firm*—Fulwider, Patton, Rieber, Lee & Utecht

[57] ABSTRACT

There is disclosed an adjustable oil filter wrench including a bearing shoe formed with a cylindrically shaped bearing pad for complimentally fitting the circumference of an oil filter cartridge and turned back along its opposite sides to form upstanding parallel ears formed with a pair of aligned diametrically projecting adjustment slots which turn laterally at their outer extremities to angle radially inwardly for a short distance to form a small filter cartridge leg. A transversely extending pivot pin is slidably received at its opposite extremities in such slots and has one end of a handle connected therewith and normally projecting laterally in one direction therefrom. A flexible band is connected with such pivot pin and projects in the direction opposite the handle and loops about the bearing surface to cooperate therewith in forming a cartridge engaging loop and has its opposite extremity connected medially with the handle.

6 Claims, 6 Drawing Figures

ADJUSTABLE OIL FILTER WRENCH

BACKGROUND OF THE INVENTION

1. Field of the Invention

The adjustable oil filter cartridge wrench of the present invention relates to a wrench which can be adjusted to accommodate different diameter oil filter cartridges.

2. Description of the Prior Art

Oil filter wrenches have long been known to the industry, and such wrenches typically have a limited amount of adjustability. With the advent of disposable oil filter cartridges and numerous different models of cars employing smaller engines and, consequently, smaller oil filter cartridges, the desirability of providing an oil filter wrench which can accommodate substantial differences in oil filter cartridge diameters has become relatively great. Further, oil filter cartridges are typically relatively thin walled members and it is desirable to spread any force applied thereto over a relatively great area in order to avoid denting and collapsing the wall of the cartridge itself. It is to the solution of these problems that the adjustable oil filter wrench of the present invention is directed. Canning jar cover wrenches have been proposed which incorporate substantial adjustability for accommodating car covers and the like of substantially different diameters. Such wrenches typically incorporate a flexible strap fastened on one end to a handle and project about the lid or cover to be unscrewed and are then received back through a gripping element for adjustably gripping the belt to define different diameter loops. Devices of this type are shown in U.S. Pat. Nos. 2,009,765 and 1,916,554. While these devices are generally acceptable for use in manipulating covers or lids where there is substantialy room for access thereto, such devices suffer substantial shortcomings for manipulating filter cartridges in the removal or tightening thereof since such cartridges are frequently located in relatively inaccessible areas within the engine compartment of various automobiles.

Numerous efforts have been made to provide oil filter wrenches and the like which incorporate a pivotal shoe intended to distribute the forces applied thereto by fulcruming of the handle during unscrewing of the lid to thus prevent denting and damage thereto. Wrenches of this type are shown in U.S. Pat. Nos. 720,753 and 994,953. However, these wrenches fail to incorporate the capability for adjustment thereof to accommodate oil filter cartridges of substantially differeing diameters.

SUMMARY OF THE INVENTION

The oil filter wrench of the present invention is characterized by a bearing shoe which incorporates an arcuate bearing surface to complimentally fit the circumference of an oil filter cartridge and having adjustment slots projecting diametrically with respect to such bearing surface and formed with transversely projecting legs for receipt therein of the opposite ends of a pivot pin carrying one end of a handle for slidable positioning at either the diametrically inner end of the slots or within the radially outwardly spaced legs to thus vary the circumference of a band connected on one end with such pivot pin and on its opposite end with the medial portion of a handle carried cantileverally from such pin. Thus, by shifting the pivot pin from the radial inner end of the slot to the transversely extending leg, the circumference of the band may be adjusted from a condition for use with a large diameter oil filter cartridge to that for a small diameter oil filter cartridge.

DESCRIPTION OF THE PREFERRED EMBODIMENT

Figure 1:
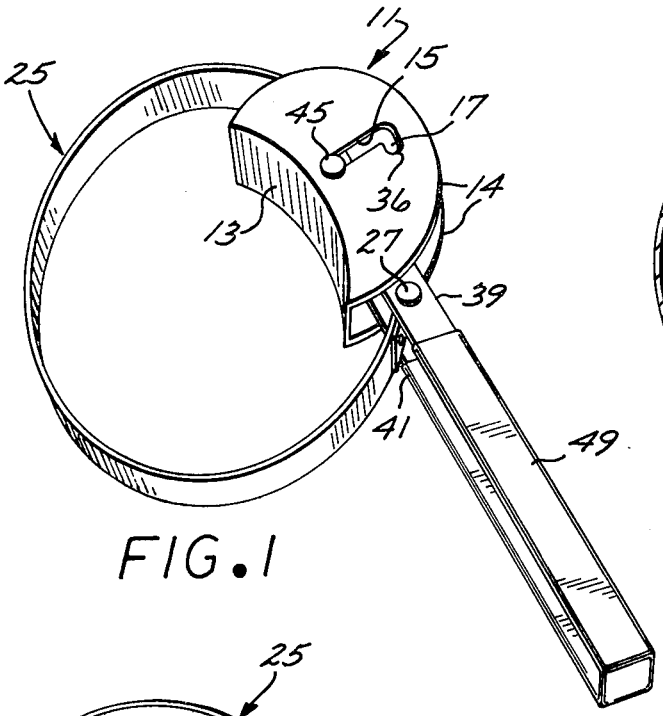
FIG. 1 is a perspective view of an adjustable oil filter cartridge wrench embodying the present invention.
Figure 2:
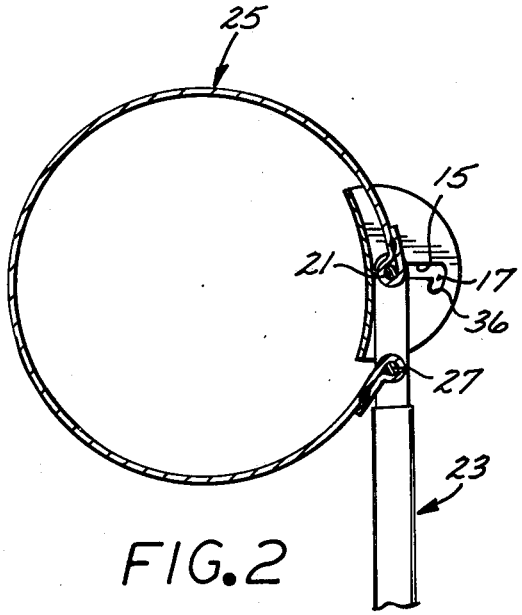
FIG. 2 is a longitudinal sectional view through the oil filter cartridge wrench shown in FIG. 1.
Figure 3:
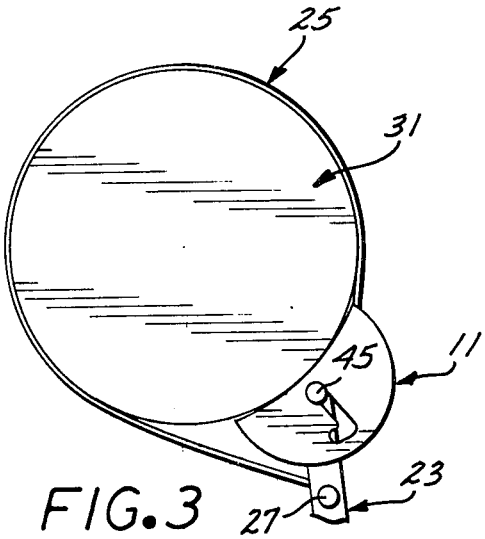
FIG. 3 is a partial top plan view of the oil filter cartridge wrench shown in FIG. 1 and depicted in use with a large diameter cartridge.
Figure 6:
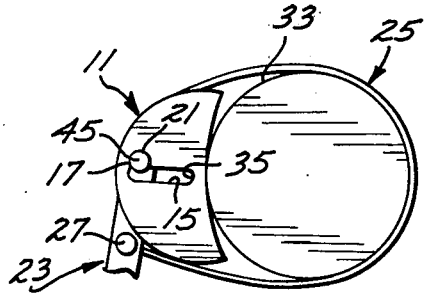
FIG. 6 is a plan view similar to FIG. 5, but showing the wrench in use with an oil filter cartridge of an even smaller diameter.

Referring to FIGS. 1 and 2, the oil filter wrench of the present invention includes, generally, a bearing shoe 11 formed with a circularly shaped bearing pad 13 having a pair of ears 14 projecting radially outwardly therefrom and themselves formed centrally with a radially projecting adjustment slot 15 which turns transversely at its outer extremity to form a laterally extending slightly radially inwardly angled small filter cartridge leg 17. Referring to FIG. 2, a transverse pivot pin 21 is received slidably on its opposite extremities in the slots 15 for sliding therethrough and selectively into the legs 17 and has one end of a handle, generally designated 23, connected therewith. A flexible band, generally designated 25, is connected on one end with the pivot pin 21 and projects therefrom to circle back on itself and cooperate with the bearing pad 13 to form a loop and is then connected on its opposite end with a connector pin 27 mounted intermediately on the handle 23. Consequently, the handle 23 may be manipulated to locate the pivot pin 21 at the radially inner extremity of the slot 15 for receipt on a large diameter oil filter cartridge 31 as shown in FIG. 3, or may be slid radially outwardly in the slots 15 to be received in the transversely extending small diameter filter cartridge slots 17 for use with a small diameter filter cartridge 33 as shown in FIG. 6.

Referring to the drawing in more detail, the bearing shoe 11 is made of heavy gauge steel and is constructed to form the coextensive ears 14 integral with the bearing pad 13. The ears 14 are formed with generally U-shaped or semi-cylindrical outline having a radius slightly less than the distance between the pivot pin 21 and the connector pin 27, such that the path of the connector pin 27 during pivoting about the inner extremity of the slots 15 follows a path generally concentric with the circular configuration of such ears.

The adjustment slots 15 are configured to project along the diameter of a circle, the circumference of which is defined by the circular bearing pad 13 and are formed on their radially inner extremities with semicircular ends 35 and then project radially outwardly and turn to angle laterally and radially inwardly for a short distance to form the slot legs 17 which terminate in semicircular ends 36 spaced radially outwardly of the ends 30.

The handle 23 is preferably constructed of heavy gauge steel and is in the form of a U-shaped yoke constructed of a metal strip and having its opposite legs 39 and 41 spaced apart to form opposed handle walls loosely but guidingly received between the spaced apart ears 14 to guide such handle as it pivots about the pin 21. The pivot pin 21 is sized to project through the opposite legs 39 and 41 of such handle 23 and is formed on its opposite extremities with enlarged-in-diameter heads 45 (FIG. 1) which have a diameter greater than the width of the slots 15 to hold such pin and, consequently, the handle 23 captive within the shoe 11. The free extremity of the handle 23 is preferably coated with a vinyl coating 49 to form a non-slip comfortable grip.

The band 25 is constructed of spring steel and has one end thereof looped loosely about the pivot pin 21 (FIG. 2) and then projects in a circular pattern to have its opposite extremity looped around the connector pin 27 which is carried between the handle legs 39 and 41.

In operation, when it is desirable to remove a large diameter oil filter cartridge 31, the handle 23 is manipulated to place the pivot pin against the radially inner ends 35 of the slots 15 (FIGS. 3 and 6) to thus cause the diameter of the circle formed by the combination of the band 25 and bearing surface 31 to be relatively large as the handle 23 is pivoted counterclockwise about the inner end 35 of the slots 15 as viewed in FIG. 1. Thus, as such handle 23 is so pivoted, the band 25 will tighten on the cartridge 31 and continued pivoting of the handle 23 about the pivot pin 21 will serve to press the bearing pad 13 radially inwardly against the circumferential wall of the cartridge 31 while drawing the band 25 even tighter on such cartridge to frictionally hold against rotation relative to the cartridge and tending to rotate such cartridge in a counterclockwise direction.

The reader will note that the relatively long ears 14 serve to guide the handle 23 as it rotates relative thereto to thus prevent relative twisting between the shoe 11 and such handle.

It will be appreciated that it is preferable to have the arrangement of the slots 15, bearing shoe 13 and length of band 25 such that the band 25 is tightened on the cartridge 31 prior to the handle 23 reaching a position projecting radially of such filter 31 to thus provide the best mechanical advantage for unscrewing of such cartridge. After the spent oil filter cartridge 31 has been removed, a new replacement cartridge may be installed and the wrench of present invention may be merely flipped over in order to be used in tightening the new filter cartridge into position.

Figure 4:
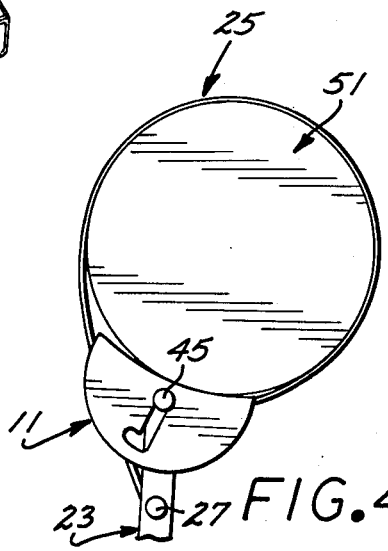
FIG. 4 is a plan view similar to FIG. 1, but depicting the wrench in use with a smaller diameter cartridge.
Figure 5:
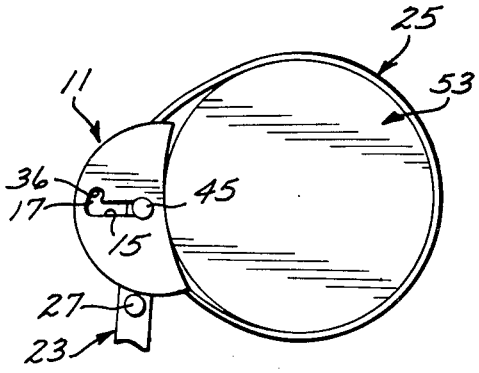
FIG. 5 is a plan view similar to FIG. 4, but showing the wrench in use with an even smaller diameter cartridge.

Referring to FIGS. 4 and 5, it can be seen that the oil filter cartridge wrench of the present invention can be utilized to loosen or tighten intermediate size oil filter cartridges 51 and 53, it being appreciated that the handle 23 merely rotates further beyond its position projecting radially of the filter 51 or 53 to thus take up the additional slack in the band 25 to thus tighten on the filter cartridge 51 or 53.

Referring to FIG. 6, when the oil filter wrench of the present invention is to be utilized in loosening a small diameter oil filter cartridge 33, the pivot pin 17 will be slid radially outwardly along the slots 15 and then into the small diameter cartridge leg 17 and pivoting of the handle 23 in a counterclockwise direction as viewed in FIG. 6 will tend to press the pivot pin 21 firmly toward the end of such leg 17 while taking up the necessary slack in the band 25 to cause it to tighten on the circumference of the cartridge 33. Continued rotation of the handle 23 will result in the cartridge 33 itself being rotated in a counterclockwise direction to enable it to be unscrewed further by hand for replacement by a new cartridge.

From the foregoing, it will be appreciated that the adjustable oil filter wrench of the present invention is of rather compact construction, self-contained and convenient to use and providing for pressure distribution throughout a substantial area of the cartridge wall to avoid denting and possible collapse thereof during use.

Various modifications and changes may be made with regard to the foregoing detailed description without departing from the spirit of the invention.

I claim:

1. An adjustable oil filter wrench for fitting an oil filter cartridge of relatively large and relatively small diameters, comprising:

a bearing shoe formed with a cylindrically shaped bearing pad having its opposite sides turned outwardly to define a pair of turned back parallel spaced apart ears, said ears being formed with a pair of adjustment slots projecting diametrically with respect to said bearing pad and terminating at their radially inner extremities with large filter cartridge ends and on their radially outer extremities with slot legs projecting transversely from said adjustment slots and angling radially inwardly to terminate in small filter cartridge ends spaced radially outwardly from said large filter cartridge ends;

an elongated hollow handle formed with opposed side walls spaced apart to fit between said ears and normally projecting transversely in one direction from said adjustment slots to project from said ears;

a pivot pin projecting outwardly from the opposite sides of said walls and slidably received in said slots;

a flexible band secured on one extremity to said pivot pin and normally projecting between said legs in a second direction opposite said one direction, looping around said bearing pad and connected on its opposite extremity intermediately with said handle, said band being of sufficient size to enable the loop formed by it and said pad, when said pivot pin is disposed at said large cartridge end and said handle projecting in said one direction, to be received over said relatively large cartridge and to then be tightened on said cartridge as said handle is pivoted away from said pad toward said second direction, said slots and legs thereof being shaped to enable the loop formed by said band and pad when said pivot pin is at said small cartridge end and said handle projecting in said first direction to be fitted over said relatively small cartridge and said handle pivoted away from said pad toward said second direction to tighten said band on said relatively small cartridge.

2. The adjustable oil filter wrench of claim 1, wherein:

said handle is formed by a U-shaped strip closed on its free end and having its opposite legs defining said opposed walls.

3. The adjustable oil filter wrench of claim 1, that includes:

a connector pin projecting between said opposed walls and having said opposite extremity of said band looped therearound for pivoting thereon.

4. The adjustable oil filter wrench of claim 1, wherein:

said handle is constructed of metal and the free end thereof is coated with polyvinyl chloride.

5. The adjustable oil filter wrench of claim 1, wherein:

said legs are arcuately shaped having a radius of curvature concentric with the radius defined by said opposite end of said band as said handle is rotated about said large cartridge ends of said slots to thus serve as guides during rotation thereof.

6. The adjustable oil filter wrench of claim 1, wherein:

said pivot pin includes heads on the opposite ends thereof which are enlarged to a diameter greater than the width of said slots.

* * * * *

Disclaimer 4,158,974.—*Teruo Yamashita*, Kasai, Japan. ADJUSTABLE OIL FILTER WRENCH. Patent dated June 26, 1979. Disclaimer filed Mar. 29, 1989, by the assignee, Mr. Gasket Co.

Hereby enters this disclaimer to the entire term of said patent.

[*Official Gazette May 23, 1989* ]